US012753455B2

(12) United States Patent
Kong et al.

(10) Patent No.: US 12,753,455 B2
(45) **Date of Patent: *Oct. 6, 2026**

(54) ULTRA-HIGH STRENGTH COLD ROLLED STEEL SHEET HAVING EXCELLENT BENDABILITY, AND METHOD OF MANUFACTURING SAME

(71) Applicant: POSCO CO., LTD, Pohang-si (KR)

(72) Inventors: Jong-Pan Kong, Gwangyang-si (KR); Yeon-Sang Ahn, Gwangyang-si (KR); Joo-Hyun Ryu, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 484 days.

This patent is subject to a terminal disclaimer.

(21) Appl. No.: 18/038,981

(22) PCT Filed: Nov. 29, 2021

(86) PCT No.: PCT/KR2021/017743

§ 371 (c)(1),
(2) Date: May 25, 2023

(87) PCT Pub. No.: WO2022/119253

PCT Pub. Date: Jun. 9, 2022

(65) Prior Publication Data

US 2024/0002968 A1 Jan. 4, 2024

(30) Foreign Application Priority Data

Dec. 3, 2020 (KR) ..... 10-2020-0167413

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 1/84* (2013.01); *C21D 6/002* (2013.01);
(Continued)

(58) Field of Classification Search
CPC ... C21D 1/18; C21D 1/19; C21D 1/74; C21D 1/84; C21D 2211/001; C21D 2211/002;
(Continued)

(56) References Cited

U.S. PATENT DOCUMENTS 11,332,803 B2 5/2022 Yokoyama et al.
2009/0053096 A1* 2/2009 Miura ..... C22C 38/04 148/320
(Continued)

FOREIGN PATENT DOCUMENTS

CN 103857820 A 6/2014
CN 104024452 A 9/2014
(Continued)

OTHER PUBLICATIONS

International Search Report—PCT/KR2021/017743 dated Mar. 8, 2022.
(Continued)

*Primary Examiner* — Jie Yang
(74) *Attorney, Agent, or Firm* — CANTOR COLBURN LLP

(57) ABSTRACT

Provided are an ultra-high strength cold rolled steel sheet having excellent bendability, and a method of manufacturing the same. The steel sheet includes 0.06 to 0.17% of C, 0.1 to 0.8% of Si, 1.9 to 2.9% of Mn, 0.005 to 0.07% of Nb, 0.004 to 0.05% of Ti, 0.0004 to 0.005% of B, 0.20% or less (excluding 0%) of Cr, and 0.04 to 0.45% of Mo, with a balance of Fe and other unavoidable impurities. a microstructure of the steel sheet includes, by area: 80 to 98% of
(Continued)

tempered martensite and a balance of fresh martensite, bainite, ferrite, and residual austenite. An average length of lath short axis of the tempered martensite is 500 nm or less.

10 Claims, 1 Drawing Sheet

(51) Int. Cl.

| | |
|---|---|
| ***C21D 1/84*** | (2006.01) |
| ***C21D 6/00*** | (2006.01) |
| ***C21D 8/02*** | (2006.01) |
| ***C21D 8/021*** | (2026.01) |
| ***C21D 8/0221*** | (2026.01) |
| ***C21D 8/0247*** | (2026.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 6/005* (2013.01); *C21D 6/008* (2013.01); *C21D 8/02* (2013.01); *C21D 8/021* (2013.01); *C21D 8/0226* (2013.01); *C21D 8/0236* (2013.01); *C21D 8/0263* (2013.01); *C22C 38/22* (2013.01); *C22C 38/26* (2013.01); *C22C 38/28* (2013.01); *C22C 38/32* (2013.01); *C22C 38/38* (2013.01); *C21D 2211/008* (2013.01)

(58) Field of Classification Search
CPC ..... C21D 2211/005; C21D 2211/008; C21D 6/002; C21D 6/005; C21D 6/008; C21D 8/0205; C21D 8/0226; C21D 8/0236; C21D 8/0263; C21D 8/0273; C21D 8/0278; C21D 9/46; C23C 2/0222; C23C 2/0224; C23C 2/26; C23C 2/28; C23C 2/29; C23C 2/50
See application file for complete search history.

(56) References Cited

U.S. PATENT DOCUMENTS

| | | | | |
|---|---|---|---|---|
| 2010/0273024 | A1 | 10/2010 | Bocharova et al. | |
| 2013/0048151 | A1 | 2/2013 | Kawamura et al. | |
| 2014/0377584 | A1 | 12/2014 | Hasegawa et al. | |
| 2018/0023154 | A1* | 1/2018 | Hasegawa | C21D 9/46 148/530 |
| 2020/0190640 | A1 | 6/2020 | Seo et al. | |
| 2020/0347473 | A1* | 11/2020 | Kohsaka | C22C 38/32 |
| 2022/0098696 | A1 | 3/2022 | Yang et al. | |
| 2024/0026483 | A1* | 1/2024 | Choi | C23C 2/0222 |
| 2024/0052468 | A1* | 2/2024 | Kong | C21D 6/002 |

FOREIGN PATENT DOCUMENTS

| | | | |
|---|---|---|---|
| EP | 3859041 | | 8/2021 |
| JP | 2528387 | | 8/1996 |
| JP | 2005264176 | | 9/2005 |
| JP | 2006183140 | A | 7/2006 |
| JP | 2009030091 | | 2/2009 |
| JP | 2010215958 | A | 9/2010 |
| JP | 2010535946 | | 11/2010 |
| JP | 2014196557 | | 10/2014 |
| KR | 20120074798 | A | 7/2012 |
| KR | 20120101596 | | 9/2012 |
| KR | 20130046941 | | 5/2013 |
| KR | 20140047960 | | 4/2014 |
| KR | 20150073844 | | 7/2015 |
| KR | 101620744 | B1 | 5/2016 |
| KR | 101630975 | | 6/2016 |
| KR | 20190075589 | A | 7/2019 |
| KR | 20200036759 | | 4/2020 |
| WO | 2018193787 | A1 | 10/2018 |
| WO | 2020067752 | A1 | 4/2020 |
| WO | 2020158065 | A1 | 8/2020 |
| WO | 2020229898 | A1 | 11/2020 |

OTHER PUBLICATIONS

Japanese Office Action—Japanese Application No. 2023-532517 issued on May 28, 2024, citing JP 2014-196557, JP 2006-183140, WO 2020/158065, KR 10-2013-0046941, and WO 2018/193787.
Chinese Office Action—Chinese Application No. 202180081661.X issued on Dec. 28, 2024, citing CN 103857820, KR 10-2019-0075589, CN 104024452, and JP 2010-215958.
European Search Report—European Application No. 21900941.2 issued on Nov. 18, 2024, citing JP 2014-196557, WO 2020/067752, KR 10-1620744, WO 2020/229898, US 2020/0190640, and KR 10-2012-0074798.

* cited by examiner

ULTRA-HIGH STRENGTH COLD ROLLED STEEL SHEET HAVING EXCELLENT BENDABILITY, AND METHOD OF MANUFACTURING SAME

TECHNICAL FIELD

The present disclosure relates to an ultra-high strength cold rolled steel sheet having excellent bendability, and a method of manufacturing the same, and more particularly, to an ultra-high strength cold rolled steel sheet having excellent bendability, which may be used for automobiles, and a method of manufacturing the same.

BACKGROUND ART

In recent years, since the establishment of safety devices has been mandatory due to reinforced safety regulations regarding automobile passengers and pedestrians, there is a problem of increased weight of a car body in contrast to weight reduction for improving vehicle fuel efficiency. Consumers are increasingly interested in hybrid or electric cars which are environmentally friendly and highly fuel-efficient, and in order to produce the environmentally friendly and safe cars, the weight of a car body structure should be reduced and the stability of the car body material should be secured. However, various devices such as an electric engine, an electric battery, and a secondary fuel storage tank as well as an existing gasoline engine provided in hybrid cars are added to such hybrid cars. In addition, as driver amenities and the like continue to increase, the car body weight is increased. Accordingly, in order to realize the weight reduction of a car body, it is essential to develop materials which are thin and are excellent in strength, ductility, and bending properties. Therefore, in order to solve the problem, it is necessary to develop a giga-grade steel sheet which may secure high strength of 980 MPa or more, high ductility, and the like.

Meanwhile, a structural material or a reinforcement serves to absorb collision energy upon a collision, thereby protecting passengers, and when the strength of a weld zone is not sufficient, the material is broken upon collision, so that sufficient collision absorption energy may not be obtained. In addition, since most of the parts to which the ultra-high strength steel materials as such are mainly applied require processing by bending like a side sill, those having poor bendability may not be used as the part, even in the case of having an excellent elongation rate. Bendability refers to a ratio of a minimum bending radius to a unit thickness (R/t), in which the minimum bending radius (R) refers to a minimum radius at which no crack occurs in an outer spherical portion of a steel sheet after a bending test. Though requirements for bendability vary somewhat from automobile company to automobile company, it is necessary to satisfy the condition of R/t 1, based on a cold rolled steel sheet having a tensile strength of 980 MPa under the standard of a Japanese automobile company. However, though some customers require 180° complete compression bending physical properties for reduced machining crack risk and excellent bendability, it is significantly difficult to secure the physical properties in an ultra-high strength steel sheet having a tensile strength of 980 MPa or more. Therefore, the development of a steel sheet having a high yield strength and excellent bendability in an ultra-high strength having a tensile strength of 980 MPa or more is urgently needed.

In order to improve bendability, the constitution and the fraction of a transformed phase present in a steel material should be appropriately controlled. In general, it is known that as a strength ratio between a soft phase such as ferrite (F) and a hard phase such as bainite (B) or martensite (M) is lower, bendability is better. To this end, bainite or tempered martensite should be produced instead of martensite, but since the transformed phases have a problem of significantly decreasing an elongation rate, it is most important to appropriately secure the constitution ratio of the transformed phases.

The conventional technology to improve the processability of the high-tensile steel sheet includes Patent Document 1. Patent Document 1 relates to a steel sheet formed of a composite structure including tempered martensite as a main body, and is characterized by dispersing fine precipitated Cu particles having a particle diameter of 1 to 100 nm inside the structure for improving processability. However, in Patent Document 1, Cu is excessively added at a content of 2 to 5% for precipitating good fine Cu particles, thereby causing red heat brittleness due to the Cu, and also, manufacturing cast rises too much.

A representative manufacturing method for increasing yield strength is using water cooling during continuous annealing. That is, performing cracking in an annealing process, immersion in water, and tempering, thereby manufacturing a steel sheet in which a microstructure is transformed from martensite into tempered martensite. A representative conventional technology of the method includes Patent Document 2. Patent Document 2 is a technology relating to manufacture of a steel material having a martensite volume ratio of 80 to 97% and a balance of ferrite, by continuously annealing a steel material having 0.18 to 0.3% of carbon, cooling the steel material to room temperature by water, and performing an overaging treatment at a temperature of 120 to 300° C. for 1 to 15 minutes. When an ultra-high strength steel is manufactured by a method of tempering after water cooling, a yield ratio is very high, but the shape quality of a coil is deteriorated by a temperature deviation in a width direction and a length direction. Therefore, in order to solve the problem and secure an appropriate microstructure, precise control of temperature and cooling conditions during continuous annealing is needed.

Meanwhile, Patent Document 3 suggests a steel sheet which has a microstructure including ferrite as a matrix structure and 2 to 10% by area of pearlite, and has improved strength by crystal grain refinement and precipitation strengthening mainly by adding a carbonitride forming element such as Ti. Patent Document 3 has a benefit of easily obtaining high strength at low manufacturing cost, but since a recrystallization temperature rapidly rises by fine precipitates, annealing at high temperature should be performed for securing ductility by causing sufficient recrystallization. In addition, it is difficult to obtain a high-strength steel of 600 MPa grade or higher with a conventional precipitation strengthened steel which is strengthened by precipitating a carbonitride in a ferrite matrix.

Therefore, the development of an ultra-high strength steel material having a tensile strength of 980 MPa or more, which has a high yield ratio to allow cold forming while having no occurrence of crack even in a 180° complete compression bending test, is being demanded, by solving the above problems.

RELATED ART DOCUMENT (Patent Document 1) Japanese Patent Laid-Open Publication No. 2005-264176

(Patent Document 2) Japanese Patent Registration Publication No. 2528387

(Patent Document 3) Korean Patent Laid-Open Publication No. 2015-0073844

DISCLOSURE

Technical Problem

An aspect of the present disclosure is to provide an ultra-high strength cold rolled steel sheet having excellent bendability and a method of manufacturing the same.

Technical Solution

According to an aspect of the present disclosure, an ultra-high cold rolled steel sheet having excellent bendability includes, by weight: 0.06 to 0.17% of C, 0.1 to 0.8% of Si, 1.9 to 2.9% of Mn, 0.005 to 0.07% of Nb, 0.004 to 0.05% of Ti, 0.0004 to 0.005% of B, 0.20% or less (excluding 0%) of Cr, and 0.04 to 0.45% of Mo with a balance of Fe and other unavoidable impurities, wherein the ultra-high cold rolled steel sheet satisfies the following Relations 1 to 3, a microstructure includes, by area: 80 to 98% of tempered martensite and a balance of fresh martensite, bainite, ferrite, and residual austenite, and an average length of lath short axis of the tempered martensite is 500 nm or less:

$$0.40 \le C + Mn/6 + (Cr + Mo + V)/5 + (Si + Ni + Cu)/15 \le 0.70 \quad \text{[Relation 1]}$$

$$110 \le 48.8 + 49\log C + 35.1\,Mn + 25.9Si + 76.5Cr + 105.9Mo + 1325Nb \le 210 \quad \text{[Relation 2]}$$

$$0.20 \le Mo + 200B \le 00.70 \quad \text{[Relation 3]}$$

wherein contents of alloy components described are based on % by weight.

According to another aspect of the present disclosure, a method of manufacturing an ultra-high cold rolled steel sheet having excellent bendability includes: heating a slab including, by weight: 0.06 to 0.17% of C, 0.1 to 0.8% of Si, 1.9 to 2.9% of Mn, 0.005 to 0.07% of Nb, 0.004 to 0.05% of Ti, 0.0004 to 0.005% of B, 0.20% or less (excluding 0%) of Cr, and 0.04 to 0.45% of Mo with a balance of Fe and other unavoidable impurities, and satisfies the following Relations 1 to 3; finish rolling the heated slab so that a finish rolling outlet side temperature is Ar3+50° C. to Ar3+150° C., thereby obtaining a hot rolled steel sheet; cooling the hot rolled steel sheet to Ms+50° C. to Ms+300° C. and then winding the steel sheet; cold rolling the wound hot rolled steel sheet to obtain a cold rolled steel sheet; continuously annealing the cold rolled steel sheet in a temperature range of 820 to 860° C.; crack treating the continuously annealed cold rolled steel sheet for 50 to 200 seconds; first cooling the crack treated cold rolled steel sheet down to 620 to 700° C. at a cooling rate of 1 to 10° C./s; second cooling the first cooled cold rolled steel sheet down to 360 to 420° C. at a cooling rate of 5 to 50° C./s; and subjecting the second cooled cold rolled steel sheet to an overaging treatment at 370 to 420° C. or the overaging treatment after reheating, wherein in the second cooling and the overaging treatment, the following Relations 4 to 8 are satisfied:

$$0.40 \le C + Mn/6 + (Cr + Mo + V)/5 + (Si + Ni + Cu)/15 \le 0.70 \quad \text{[Relation 1]}$$

$$110 \le 48.8 + 49\log C + 35.1\,Mn + 25.9Si + 76.5Cr + 105.9Mo + 1325Nb \le 210 \quad \text{[Relation 2]}$$

$$0.20 \le Mo + 200B \le 00.70 \quad \text{[Relation 3]}$$

$$0 \le A \le 50 \quad \text{[Relation 4]}$$

$$0 \le B \le 40 \quad \text{[Relation 5]}$$

$$0 \le 2.8A + 0.5B \le 100 \quad \text{[Relation 6]}$$

$$0 \le 3.1A + 2.3B \le 200 \quad \text{[Relation 7]}$$

$$0.25 \le (3.1A + 2.3B)/(2.8A + 0.5B) \le 3.5 \quad \text{[Relation 8]}$$

wherein contents of alloy components described in Relations 1 to 3 are based on % by weight, and A is Ms—a second cooling end temperature (° C.) and B is an overaging treatment temperature—a second cooling end temperature (° C.), in Relations 4 to 8.

Advantageous Effects

According to an exemplary embodiment in the present disclosure, an ultra-high strength cold rolled steel sheet having excellent bendability and a method of manufacturing the same may be provided.

BEST MODE FOR INVENTION

Figure 1:
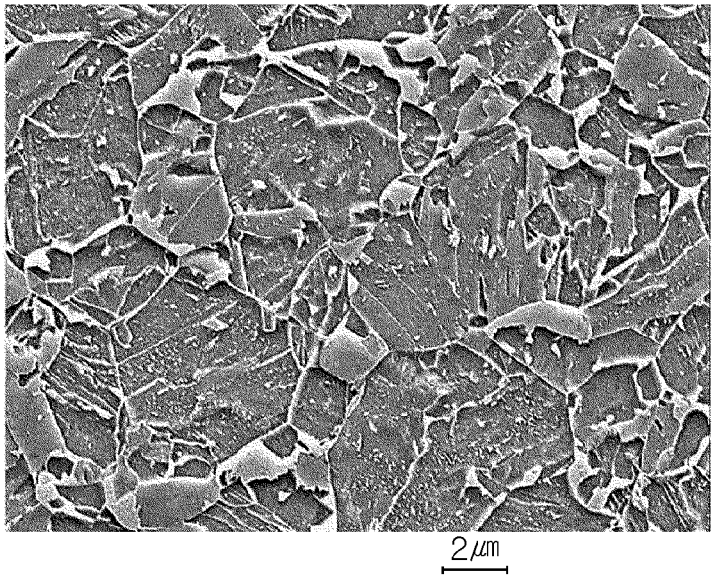
FIG. 1 is an image of a microstructure of Inventive Example 1 according to an exemplary embodiment in the present disclosure, which was observed by SEM.

Hereinafter, the ultra-high strength cold rolled steel sheet having excellent bendability according to an exemplary embodiment in the present disclosure will be described. First, the alloy composition of the present disclosure will be described. The contents of the alloy composition described hereinafter are based on weight, unless otherwise separately stated.

C: 0.06 to 0.17%

Carbon (C) is a very important element which is added for solid solution strengthening. In addition, carbon binds to a precipitated element to produce a fine carbide, thereby contributing to strength improvement. When the content of C is less than 0.06%, it is very difficult to secure desired strength. However, when the content of C is more than 0.17%, martensite is excessively formed during cooling due to increased hardenability, thereby rapidly increasing strength to deteriorate bendability. In addition, weldability is poor to increase a possibility to cause welding defects when a customer processes parts. Therefore, it is preferred that the content of C is in a range of 0.06 to 0.17%. The lower limit of the content of C is more preferably 0.08%, and more preferably 0.10%. The upper limit of the content of C is more preferably 0.165%, more preferably 0.16%, and most preferably 0.145%.

Si: 0.1 to 0.8%

Silicon (Si) is one of five elements of a steel, and is naturally added in a small amount during a manufacturing process. Si contributes to a strength increase and suppresses production of a carbide, so that carbon is not produced as a carbide during an annealing crack treatment and cooling. In addition, the carbon is distributed and accumulated in residual austenite, whereby an austenite phase remains at room temperature to be favorable for securing an elongation rate. When the content of Si is less than 0.1%, it may be difficult to sufficiently secure the effect described above. However, when the content of Si is more than 0.80%, surface scale defects are caused to degrade plated surface quality, thereby deteriorating formation treatability. Therefore, it is preferred that the content of Si is in a range of 0.1 to 0.8%. The lower limit of the content of Si is more preferably 0.2%, and more preferably 0.3%. The upper limit of the content of Si is more preferably 0.7%, and more preferably 0.6%.

Mn: 1.9 to 2.9%

Manganese (Mn) is an element which precipitates sulfur in a steel as MnS to prevent hot brittleness by the production of FeS, and also performs solid solution strengthening of a steel. When the content of Mn is less than 1.9%, it is difficult to secure the strength targeted by the present disclosure. However, when the content of Mn is more than 2.9%, problems such as weldability and hot rollability are likely to arise, and also hardenability is increased to form martensite more excessively, resulting in a decrease in an elongation rate. In addition, a Mn-band (band of a Mn oxide) is formed in a microstructure to increase a risk of occurrence of processing cracks and plate breakage, and the Mn oxide is eluted on the surface during annealing to greatly deteriorate plating properties. Therefore, it is preferred that the content of Mn is in a range of 1.9 to 2.9%. The lower limit of the content of Mn is more preferably 2.0%, and more preferably 2.1%. The upper limit of the content of Mn is more preferably 2.8%, and more preferably 2.7%.

Nb: 0.005 to 0.07%

Niobium (Nb) is an element which is segregated at an austenite grain boundary, suppresses coarsening of austenite crystal grains during an annealing heat treatment, and forms a fine carbide to contribute to a strength increase. When the content of Nb is less than 0.005%, the effects described above are insufficient. However, when the content of Nb is more than 0.07%, a coarse carbide is precipitated, strength and an elongation rate may be decreased by a decrease in a solid solubilized carbon amount in a steel, and manufacturing costs may be increased. Therefore, it is preferred that the content of Nb is in a range of 0.005 to 0.07%. The lower limit of the content of Nb is more preferably 0.01%, and more preferably 0.015%. The upper limit of the content of Nb is more preferably 0.06%, and more preferably 0.05%.

Ti: 0.004 to 0.05%

Titanium (Ti) is a fine carbide forming element and contributes to securing yield strength and tensile strength. In addition, Ti is a nitride forming element, and has an effect of precipitating N in a steel as TiN to suppress AlN precipitation, thereby decreasing a risk of occurrence of cracks during continuous casting. When the content of Ti is less than 0.004%, it may be difficult to obtain the effects described above. However, the content of Ti is more than 0.05%, a coarse carbide is precipitated, strength and an elongation rate may be decreased by a decrease in a solid solubilized carbon amount in a steel, and nozzle clogging may be caused during soft casting. Therefore, it is preferred that the content of Ti is in a range of 0.004 to 0.05%. The lower limit of the content of Ti is more preferably 0.008%, and more preferably 0.012%. The upper limit of the content of Ti is more preferably 0.04%, and more preferably 0.03%.

B: 0.0004 to 0.005%

Boron (B) is an element which greatly contributes to securing hardenability of a steel material, and it is preferred to add 0.0004% or more of boron for obtaining the effect. However, when the content of B is more than 0.005%, a boron carbide is formed in a grain boundary to provide a nucleation site of ferrite, and thus, hardenability may be rather deteriorated. Therefore, it is preferred that the content of B is in a range of 0.0004 to 0.005%. The lower limit of the content of B is more preferably 0.0006%, and more preferably 0.0008%. The upper limit of the content of B is more preferably 0.004%, and more preferably 0.003%.

Cr: 0.20% or Less (Excluding 0%)

Chromium (Cr) is an element which improves hardenability and increases the strength of a steel. However, when the content of Cr is more than 0.2%, a penetration corrosion problem due to non-uniform production of a Cr oxide in a salty atmosphere may arise. Therefore, it is preferred that the content of Cr is in a range of 0.20% or less. The content of Cr is more preferably 0.15% or less, and more preferably 0.10% or less. Meanwhile, since the effect of improving hardenability and strength may be obtained only in a small amount in the present disclosure, the lower limit of Cr is not particularly limited.

Mo: 0.04 to 0.45%

Molybdenum (Mo) is an element which forms a carbide, and when added with a carbonitride forming element such as Ti, Nb, and V in combination, finely maintains the size of the precipitate to serve to improve yield strength and tensile strength. In addition, Mo improves the hardenability of a steel to finely form martensite in a grain boundary, thereby allowing control of a yield ratio. For the effects described above, it is preferred to add 0.04% or more of Mo. However, since Mo is an expensive element, a higher content is unfavorable for the manufacture, and thus, it is preferred to appropriately control the content. When the content of Mo is more than 0.45%, manufacturing costs rise sharply to deteriorate economic feasibility, and due to an excessive crystal grain refinement effect and a solid solution strengthening effect, the ductility of a steel is rather deteriorated. Therefore, it is preferred that the content of Mo is in a range of 0.04 to 0.45%. The lower limit of the content of Mo is more preferably 0.06%, and more preferably 0.08%. The upper limit of the content of Mo is more preferably 0.40%, and more preferably 0.35%.

Meanwhile, it is preferred that the cold rolled steel sheet of the present disclosure satisfies the alloy components described above, and also satisfies the following Relations 1 to 3. Thus, an ultra-high strength steel sheet having excellent bendability and a tensile strength of 980 MPa or more which is targeted by the present disclosure may be manufactured.

$$0.40 \leq C + Mn/6 + (Cr + Mo + V)/5 + (Si + Ni + Cu)/15 \leq 0.70 \quad \text{[Relation 1]}$$

Relation 1 is a component relation for securing strength and weldability. When the value of Relation 1 is less than 0.40, it is difficult to secure the material and weld zone strength which are targeted by the present disclosure, and when the value is more than 0.70, weldability may be deteriorated. Therefore, it is preferred that the value of Relation 1 is in a range of 0.40 to 0.70. The lower limit of the value of Relation 1 is more preferably 0.45, and more preferably 0.50. The upper limit of the value of $$110 \leq 48.8 + 49\log C + 35.1\,Mn + 25.9Si + 76.5Cr + 105.9Mo + 1325Nb \leq 210 \quad \text{[Relation 2]}$$

Relation 2 is a component relation related to a hardenability index for securing hardenability. When the value of Relation 2 is less than 110, it is difficult to secure the strength targeted by the present disclosure due to the lack of hardenability, and when the value is more than 210, hardenability is excessively high to deteriorate bendability. Therefore, it is preferred that the value of Relation 2 is in a range of 100 to 200. The lower limit of the value of Relation 2 is more preferably 120, and more preferably 130. The upper limit of the value of Relation 2 is more preferably 200, and more preferably 190.

$$0.20 \leq Mo + 200B \leq 00.70 \quad \text{[Relation 3]}$$

Relation 3 is a component relation for more stably securing strength targeted by the present disclosure. When the value of Relation 3 is less than 0.20, it is difficult to secure the strength targeted by the present disclosure due to the lack of hardenability, and when the value is more than 0.70, hardenability is excessively high to deteriorate bendability, and manufacturing costs are increased. Therefore, it is preferred that the value of Relation 3 is in a range of 0.20 to 0.70. The lower limit of the value of Relation 3 is more preferably 0.25, and more preferably 0.30. The upper limit of the value of Relation 3 is more preferably 0.65, and more preferably 0.60.

The remaining component of the present disclosure is iron (Fe). However, since in a common manufacturing process, unintended impurities may be inevitably incorporated from raw materials or the surrounding environment, the impurities may not be excluded. Since these impurities are known to any person skilled in the common manufacturing process, the entire contents thereof are not particularly mentioned in the present specification.

Meanwhile, the impurities include one or more of P, S, Al, Sb, N, Mg, Sn, Sb, Zn, and Pb as a tramp element, of which the sum may be 0.1% by weight or less. The tramp element is an impurity element from scrap and the like, which is used as a raw material in a steelmaking process, and when the sum is more than 0.1%, surface cracks of a slab may be caused, and the surface quality of a steel sheet may be deteriorated.

Hereinafter, a microstructure and the like of the ultra-high strength cold rolled steel sheet having excellent bendability according to an exemplary embodiment in the present disclosure will be described.

It is preferred that the microstructure of the cold rolled steel sheet of the present disclosure includes, by area: 80 to 98% of tempered martensite and a balance of fresh martensite, bainite, ferrite, and residual austenite. The microstructure of the cold rolled steel sheet of the present disclosure includes tempered martensite (hereinafter, also referred to as "TM") as a main structure. However, when the fraction of the tempered martensite is less than 80%, it is difficult to secure the targeted strength, and when the fraction is more than 98%, bendability and an elongation rate may be poor. Therefore, it is preferred that the fraction of the martensite is in a range of 80 to 98%. The lower limit of the fraction of martensite is more preferably 82%, and more preferably 84%. The upper limit of the fraction of martensite is more preferably 97%, and more preferably 96%. Fresh martensite (hereinafter, also referred to as "FM"), bainite (hereinafter, also referred to as "B"), ferrite (hereinafter, also referred to as "F"), and residual austenite (hereinafter, also referred to as "RA") are microstructures which are inevitably formed in the manufacturing process. However, the residual structure also has a positive function in the present disclosure. The fresh martensite is a structure favorable for securing strength. Therefore, as the fraction of the fresh martensite is higher, it is favorable for securing strength, but when the fraction is more than 11%, an elongation rate and bendability may be poor. Therefore, it is preferred that the fraction of the fresh martensite is 11% or less. The fraction of the fresh martensite is more preferably 10% or less, more preferably 9% or less, and most preferably 8% or less.

The bainite may play an important role in improving bending properties by contributing to a decrease in a hardness difference between phases. However, when the fraction is more than 3%, the fraction of martensite is relatively decreased, so that it is difficult to secure the targeted strength. The ferrite is a structure favorable for securing an elongation rate. However, when the fraction is more than 3%, the fraction of martensite is relatively decreased, so that it may be difficult to secure the targeted strength. The residual martensite is a structure favorable for securing an elongation rate. However, when the fraction is more than 3%, the fraction of martensite is relatively decreased, so that it may be difficult to secure the targeted strength. Therefore, it is preferred that the fractions of bainite, ferrite, and residual austenite are 3% or less, respectively.

Meanwhile, it is preferred that the average length of lath short axis of the tempered martensite is 500 nm or less. A narrower lath spacing of the tempered martensite is favorable for securing strength and bendability. However, when the average length of lath short axis of the tempered martensite is more than 500 nm, it is difficult to obtain the effect. The average length of lath short axis is more preferably 400 nm or less, and more preferably 300 nm or less.

The cold rolled steel sheet of the present disclosure which is provided as described above may have a yield strength (YS) of 780 to 920 MPa, a tensile strength (TS) of 980 to 1200 MPa, an elongation rate (EL) of 8% or more, a yield ratio (YS/TS) of 0.75 or more, a hole expansion ratio (HER) of 40% or more, and a bendability (YS×EL×HER) of 300 GPa %% or more, and has no crack occurrence in a 180° complete compression bending test. The yield strength is more preferably 790 to 910 MPa, and more preferably 800 to 900 MPa. The tensile strength is more preferably 990 to 1180 MPa, and more preferably 1000 to 1160 MPa. The elongation rate is more preferably 9% or more, and more preferably 10% or more. The yield ratio is more preferably 0.76 or more, and more preferably 0.77 or more. The hole expansion ratio is more preferably 45% or more, and more preferably 50% or more. The bendability is more preferably 350 GPa %% or more, and more preferably 400 GPa %% or more. Meanwhile, the 180° complete compression bending test may be performed by first bending a steel sheet to be measured at 90°, putting another steel sheet having twice the thickness of the steel sheet in between, and bending the steel sheet to be measured at 180° again to be completely compressed.

Hereinafter, a method of manufacturing an ultra-high strength cold rolled steel sheet having excellent bendability according to an exemplary embodiment in the present disclosure will be described.

First, a slab satisfying the alloy composition described above is heated. Though the slab heating temperature is not particularly limited in the present disclosure, the heating of the slab may be performed, for example, at 1100 to 1300° C. When the slab heating temperature is lower than 1100° C., a slab temperature is low so that a rolling load may occur during rough rolling, and when the temperature is higher than 1300° C., the structure may be coarsened and electricity costs may rise. The lower limit of the slab heating temperature is more preferably 1125° C., and more preferably 1150° C. The upper limit of the slab heating temperature is more preferably 1275° C., and more preferably 1250° C. Meanwhile, the slab may have a thickness of 230 to 270 mm.

Thereafter, the heated slab is finish rolled so that a finish rolling outlet side temperature is Ar3+50° C. to Ar3+150° C., thereby obtaining a hot rolled steel sheet. When the finish rolling outlet side temperature is lower than Ar3+50° C., hot deformation resistance is highly likely to be sharply increased. When the finish rolling outlet side temperature is higher than Ar3+150° C., an oxidation scale which is too thick occurs, and also the microstructure of a steel sheet is highly likely to be coarsened. Therefore, it is preferred that the finish rolling outlet side temperature is in a range of Ar3+50° C. to Ar3+150° C. The lower limit of the finish rolling outlet side temperature is more preferably Ar3+60° C., and more preferably Ar3+70° C. The upper limit of the finish rolling outlet side temperature is more preferably Ar3+140° C., and more preferably Ar3+130° C.

Thereafter, the hot rolled steel sheet is cooled down to Ms+50° C. to Ms+300° C., and then is wound. When a winding temperature is lower than Ms+50° C., excessive martensite or bainite is produced to cause an excessive increase in strength of a hot rolled steel sheet, thereby causing a problem such as a poor shape due to a load during cold rolling. However, when the temperature is higher than Ms+300° C., pickling properties may be deteriorated. Therefore, it is preferred that the winding temperature is in a range of Ms+50° C. to Ms+300° C. The lower limit of the winding temperature is more preferably Ms+60° C., and more preferably Ms+70° C. The upper limit of the winding temperature is more preferably Ms+290° C., and more preferably Ms+270° C. Meanwhile, after the winding, the wound hot rolled steel sheet may be cooled down to room temperature at a cooling rate of 0.1° C./s or less.

Thereafter, the wound and cooled hot rolled steel sheet is cold rolled to obtain a cold rolled steel sheet. The cold rolling may be performed at a reduction rate of 40 to 70%. When the cold reduction rate is less than 40%, a recrystallization driving force is weakened, so that a problem in obtaining good recrystallized grains is highly likely to arise, and it is very difficult to correct the shape. When the cold reduction rate is more than 70%, cracks are highly likely to occur in an edge portion and a rolling load may be sharply increased. Therefore, it is preferred that the cold rolling is performed at a reduction rate of 40 to 70%. Meanwhile, pickling may be performed for removing scale or impurities attached to the surface, before the cold rolling.

Thereafter, the cold rolled steel sheet is continuously annealed in a temperature range of 820 to 860° C. When the continuous annealing temperature is lower than 820° C., it is difficult to form sufficient austenite, so that it is difficult to secure strength targeted by the present disclosure. However, when the temperature is higher than 860° C., an austenite crystal grain size is coarsened to deteriorate the bendability of a final product. Therefore, it is preferred that the continuous annealing temperature is in a range of 820 to 860° C. The lower limit of the continuous annealing temperature is more preferably 825° C., and more preferably 830° C. The upper limit of the continuous annealing temperature is more preferably 855° C., and more preferably 850° C.

Thereafter, the continuously annealed cold rolled steel sheet is crack treated for 50 to 200 seconds. This is for securing a sufficient austenite fraction at an annealing temperature suggested in the present disclosure, together with the recrystallization and crystal grain growth of the cold rolled structure. When the crack treatment time is less than 50 seconds, sufficient reverse transformation into austenite does not sufficiently occur, and thus, a ferrite fraction is increased in a final structure so that it may be difficult to secure the targeted strength. However, when the crack treatment time is more than 200 seconds, the austenite crystal grain size is coarsened, so that the bendability of a final product may be deteriorated. The lower limit of the crack treatment time is more preferably 55 seconds, and more preferably 60 seconds. The upper limit of the crack treatment time is more preferably 190 seconds, and more preferably 180 seconds.

Thereafter, the crack treated cold rolled steel sheet is first cooled down to 620 to 700° C. at a cooling rate of 1 to 10° C./s. The first cooling step is for securing an equilibrium carbon concentration of ferrite and austenite to increase the ductility and the strength of a steel sheet. When the first cooling end temperature is lower than 630° C. or higher than 700° C., it is difficult to secure the ductility and the strength targeted by the present disclosure. When the cooling rate is less than 1° C./s, ferrite transformation is accelerated so that it is difficult to secure the targeted microstructure fraction, and when the cooling rate is more than 10° C./s, it is difficult to secure the elongation rate due to excessive martensite transformation.

Thereafter, the first cooled cold rolled steel sheet is second cooled down to 360 to 420° C. at a cooling rate of 5 to 50° C./s. The second cooling is one of important control factors in the present disclosure, and the second cooling end temperature is a very important condition for securing all of strength, ductility, and bendability. When the second cooling end temperature is lower than 360° C., it is difficult to secure ductility due to an excessive increase in martensite fraction, and when the temperature is higher than 420° C., it is difficult to secure sufficient martensite so that it is difficult to secure the targeted strength. Therefore, it is preferred that the second cooling end temperature which is one of important control factors for securing the physical properties targeted by the present disclosure is in a range of 360 to 420° C. The lower limit of the second cooling end temperature is more preferably 365° C., and more preferably 370° C. The upper limit of the second cooling end temperature is more preferably 405° C., and more preferably 400° C. When the second cooling rate is less than 5° C./s, ferrite transformation occurs first before martensite and bainite transformation, due to a low cooling rate, so that an appropriate microstructure fraction to be obtained in the present disclosure is not obtained, and when the second cooling rate is more than 50° C./s, treading is deteriorated and plate breakage may occur due to a shape inferiority problem by an excessive cooling rate. The lower limit of the second cooling rate is more preferably 7.5° C./s, and more preferably 10° C./s. The upper limit of the second cooling rate is more preferably 47.5° C./s, and more preferably 45° C./s.

Meanwhile, in order to secure the fraction of tempered martensite which is an important microstructure in the present disclosure to a target level, it is important to precisely control a difference between the Ms temperature and the second cooling end temperature. More specifically, it is preferred to satisfy the following Relation 4. A difference between Ms and the second cooling end temperature, that is, the value of A is less than 0, martensite transformation is small so that it may be difficult to secure the targeted steel, and the value of A is more than 50° C., a time to stay in a martensite region is long so that it is difficult to secure ductility due to an excessive increase in martensite fraction. Therefore, it is preferred that the difference between Ms and the second cooling end temperature, that is, the A value is 0 to 50° C. The lower limit of the A value is more preferably 1° C., and more preferably 2° C. The upper limit of the A value is more preferably 45° C., and more preferably 40° C. Meanwhile, Ms refers to a temperature at which martensite transformation starts, and the value may be calculated by the following Equation 1:

$$0 \le A \le 50 \quad \text{[Relation 4]}$$

wherein A is Ms—second cooling end temperature (° C.), $$Ms = 539 - 423C - 30.4Mn - 7.5Si + 30Al. \quad \text{[Equation 1]}$$

Thereafter, the second cooled cold rolled steel sheet is subjected to an overaging treatment at 370 to 420° C. or the overaging treatment after reheating. It is preferred that the overaging treatment is performed at the same temperature as or a higher temperature than the second cooling end temperature. The overaging treatment is a process for promoting transformation of fresh martensite produced at the end of the second cooling into tempered martensite, and thus, high yield strength and bendability may be stably secured. Therefore, the overaging treatment temperature is a very important factor for securing high bendability targeted by the present disclosure, and the overaging treatment temperature is precisely controlled to a range of 370 to 420° C. in the present disclosure. When the overaging treatment temperature is lower than 370° C., transformation of fresh martensite into tempered martensite is small so that bendability may be poor. However, when the overaging treatment temperature is higher than 420° C., it may be difficult to secure tensile strength due to excessive tempered martensite transformation. Therefore, it is preferred that the overaging treatment temperature is in a range of 370 to 420° C. The lower limit of the overaging treatment temperature is more preferably 375° C., and more preferably 380° C. The upper limit of the overaging treatment temperature is more preferably 415° C., and more preferably 410° C.

Meanwhile, in order to secure the fraction of tempered martensite which is an important microstructure in the present disclosure to a target level, it is important to precisely control the overaging treatment temperature and the second cooling end temperature. More specifically, it is preferred to satisfy the following Relation 5. A difference between the overaging treatment temperature and the second cooling end temperature, that is, the value of B is less than 0, it is difficult to obtain an overaging treatment effect, and the value of B is more than 40° C., it may be difficult to secure the targeted tensile strength due to excessive tempered martensite transformation. Therefore, it is preferred that the difference between the overaging treatment temperature and the second cooling end temperature, that is, the B value is 0 to 40° C. The lower limit of the B value is more preferably 2.5° C., and more preferably 5° C. The upper limit of the B value is more preferably 35° C., and more preferably 30° C.

$$0 \le B \le 40 \quad \text{[Relation 5]}$$

wherein B is overaging treatment temperature—second cooling end temperature (° C.).

In addition, for the microstructure fraction and the strength level targeted by the present disclosure, it is preferred to satisfy the following Relations 6 to 8 during the second cooling and overaging treatment.

$$0 \le 2.8A + 0.5B \le 100 \quad \text{[Relation 6]}$$

Relation 6 is for securing the yield strength targeted by the present disclosure. When the value of Relation 6 is less than 0, it is difficult to secure sufficient martensite so that it is difficult to obtain high yield strength, and when the value is more than 100, the yield strength is excessively high due to excessive securing of tempered martensite. Therefore, it is preferred that the value of Relation 6 is in a range of 0 to 100. The lower limit of the value of Relation 6 is more preferably 2, and more preferably 4. The upper limit of the value of Relation 6 is more preferably 90, and more preferably 80.

$$0 \le 3.1A + 2.3B \le 200 \quad \text{[Relation 7]}$$

Relation 7 is for securing the tensile strength targeted by the present disclosure. When the value of Relation 7 is less than 0, it is difficult to secure sufficient fresh martensite so that it is difficult to secure the targeted tensile strength, and when the value of Relation 7 is more than 200, transformation into tempered martensite occurs excessively so that it is difficult to secure tensile strength. Therefore, it is preferred that the value of Relation 7 is in a range of 0 to 200. The lower limit of the value of Relation 7 is more preferably 2, and more preferably 4. The upper limit of the value of Relation 7 is more preferably 190, and more preferably 180.

$$0.25 \le (3.1A + 2.3B)/(2.8A + 0.5B) \le 3.5 \quad \text{[Relation 8]}$$

Relation 8 is for securing both yield strength and tensile strength targeted by the present disclosure. When the value of Relation 8 is less than 0.25 or more than 3.5, it is difficult to secure the targeted structure fraction so that it is difficult to secure both yield strength and tensile strength to be desired. Therefore, it is preferred that the value of Relation 8 is in a range of 0.25 to 3.5. The lower limit of the value of Relation 8 is more preferably 0.50, and more preferably 0.75. The upper limit of the value of Relation 87 is more preferably 3.25, and more preferably 3.0.

Meanwhile, in the present disclosure, a step of roughly rolling the overaging treated cold rolled steel sheet at an elongation rate of 0.1 to 2.0% may be further included, after the overaging treatment. In the case of common coarse rolling, the tensile strength is hardly increased, so that an increase in yield strength of at least 50 MPa or more occurs. When the elongation rate is less than 0.1%, it may be difficult to control the shape, and when the elongation rate is more than 2.0%, operability may be greatly unstable due to a high stretch work.

MODE FOR INVENTION

Hereinafter, the present disclosure will be described in more detail by the following examples. However, it should be noted that the following Examples are only for describing the present disclosure in detail by illustration, and are not intended to limit the right scope of the present disclosure. The reason is that the right scope of the present disclosure is determined by the matters described in the claims and reasonably inferred therefrom.

EXAMPLES

A molten steel having an alloy composition described in Table 1 was prepared and continuously cast to manufacture a slab having a thickness of 250 mm. The slab was heated to 1200° C. for 12 hours, was hot rolled, and then was wound. At this time, a finish rolling outlet side temperature in the hot rolling was controlled to a range of Ar3+50° C. to Ar3+150° C., and a winding temperature was controlled to a range of Ms+50° C. to Ms+300° C. Thereafter, a hot rolled steel sheet having a thickness of 3.2 mm obtained by the hot rolling was pickled, and was cold rolled at a cold reduction rate of 50% to obtain a cold rolled steel sheet having a thickness of 1.6 mm. The cold rolled steel sheet was manufactured into a final product using the conditions described in the following Tables 2 and 3. The mechanical properties of the thus-manufactured cold rolled steel sheet were measured, and the results are shown in the following Table 4.

The fraction of the microstructure was measured using electron backscatter diffraction (EBSD) equipment. The average length of lath short axis of tempered martensite was obtained by randomly taking photographs of five sites at a 40,000× magnification with a transmission electron microscope (TEM), performing measurement using a software of Image-Plus Pro, and then performing calculation as an average value. Meanwhile, the measured microstructure was formed of tempered martensite with a balance of fresh martensite, bainite, ferrite, and residual austenite in a mixed state.

Tensile strength (TS), yield strength (YS), and elongation rate (EL) were measured by a tensile test in a rolling horizontal direction, and a specimen specification with a gauge length of 50 mm and a width of a tensile specimen of 25 mm was used.

Hole expansion ratio (HER) was measured in accordance with the standard of ISO 16330, and the hole was sheared with a clearance of 12% using a punch having a diameter of 10 mm.

In a 180° complete compression bending test, a steel sheet to be measured was first bent at 90°, another steel sheet having twice the thickness of the steel sheet was put in between, the steel sheet to be measured was bent at 180° again to be completely compressed, and it was visually determined whether cracks occurred. When cracks occurred, it was indicated as ○, and when cracks did not occur, it was indicated as x.

TABLE 1

| | Alloy composition (% by weight) | | | | | | | | | | |
|---|---|---|---|---|---|---|---|---|---|---|---|
| Steel type No. | C | Si | Mn | Nb | Ti | B | Cr | Mo | Relation 1 | Relation 2 | Relation 3 |
| Inventive steel 1 | 0.13 | 0.40 | 2.40 | 0.028 | 0.020 | 0.0011 | 0.01 | 0.17 | 0.59 | 156 | 0.39 |
| Inventive steel 2 | 0.12 | 0.40 | 2.40 | 0.029 | 0.019 | 0.0010 | 0.01 | 0.17 | 0.58 | 155 | 0.37 |
| Inventive steel 3 | 0.13 | 0.35 | 2.40 | 0.030 | 0.017 | 0.0012 | 0.01 | 0.17 | 0.59 | 157 | 0.41 |
| Inventive steel 4 | 0.13 | 0.40 | 2.40 | 0.031 | 0.020 | 0.0010 | 0.01 | 0.17 | 0.59 | 160 | 0.37 |
| Inventive steel 5 | 0.13 | 0.40 | 2.39 | 0.035 | 0.021 | 0.0014 | 0.01 | 0.17 | 0.59 | 165 | 0.45 |
| Inventive steel 6 | 0.13 | 0.40 | 2.45 | 0.031 | 0.022 | 0.0010 | 0.01 | 0.17 | 0.60 | 162 | 0.37 |
| Inventive steel 7 | 0.13 | 0.40 | 2.37 | 0.030 | 0.021 | 0.0012 | 0.01 | 0.17 | 0.59 | 157 | 0.41 |
| Inventive steel 8 | 0.11 | 0.40 | 2.38 | 0.027 | 0.020 | 0.0011 | 0.01 | 0.21 | 0.58 | 155 | 0.43 |
| Inventive steel 9 | 0.11 | 0.40 | 2.39 | 0.028 | 0.023 | 0.0005 | 0.01 | 0.21 | 0.58 | 156 | 0.31 |
| Inventive steel 10 | 0.11 | 0.39 | 2.36 | 0.027 | 0.020 | 0.0005 | 0.01 | 0.41 | 0.61 | 175 | 0.51 |
| Inventive steel 11 | 0.12 | 0.39 | 2.39 | 0.028 | 0.020 | 0.0012 | 0.01 | 0.41 | 0.63 | 179 | 0.65 |
| Inventive steel 12 | 0.11 | 0.40 | 2.42 | 0.029 | 0.021 | 0.0006 | 0.01 | 0.41 | 0.62 | 180 | 0.53 |
| Inventive steel 13 | 0.13 | 0.40 | 2.41 | 0.030 | 0.020 | 0.0010 | 0.01 | 0.17 | 0.59 | 159 | 0.37 |
| Inventive steel 14 | 0.12 | 0.39 | 2.40 | 0.029 | 0.020 | 0.0009 | 0.01 | 0.18 | 0.58 | 156 | 0.36 |
| Inventive steel 15 | 0.14 | 0.37 | 2.40 | 0.028 | 0.020 | 0.0010 | 0.01 | 0.17 | 0.60 | 157 | 0.37 |
| Inventive steel 16 | 0.12 | 0.40 | 2.40 | 0.027 | 0.020 | 0.0010 | 0.01 | 0.17 | 0.58 | 153 | 0.37 |

TABLE 1-continued

| Steel type No. | Alloy composition (% by weight) | | | | | | | | | | |
|---|---|---|---|---|---|---|---|---|---|---|---|
| | C | Si | Mn | Nb | Ti | B | Cr | Mo | Relation 1 | Relation 2 | Relation 3 |
| Inventive steel 17 | 0.11 | 0.40 | 2.41 | 0.029 | 0.020 | 0.0011 | 0.01 | 0.16 | 0.57 | 153 | 0.38 |
| Inventive steel 18 | 0.12 | 0.41 | 2.40 | 0.030 | 0.020 | 0.0010 | 0.01 | 0.17 | 0.58 | 157 | 0.37 |
| Inventive steel 19 | 0.13 | 0.31 | 2.41 | 0.030 | 0.020 | 0.0010 | 0.01 | 0.16 | 0.59 | 155 | 0.36 |
| Inventive steel 20 | 0.14 | 0.41 | 2.40 | 0.030 | 0.020 | 0.0010 | 0.01 | 0.15 | 0.60 | 158 | 0.35 |
| Inventive steel 21 | 0.12 | 0.40 | 2.39 | 0.029 | 0.020 | 0.0010 | 0.01 | 0.17 | 0.58 | 155 | 0.37 |
| Inventive steel 22 | 0.13 | 0.42 | 2.40 | 0.027 | 0.020 | 0.0010 | 0.01 | 0.16 | 0.59 | 154 | 0.36 |
| Comparative steel 1 | 0.13 | 0.39 | 2.39 | 0.028 | 0.020 | 0 | 0.01 | 0.01 | 0.56 | 138 | 0.01 |
| Comparative steel 2 | 0.12 | 0.40 | 2.41 | 0.028 | 0.020 | 0.0006 | 0.01 | 0.01 | 0.55 | 138 | 0.13 |
| Comparative steel 3 | 0.12 | 0.40 | 1.60 | 0.028 | 0.020 | 0.0005 | 0.01 | 0.01 | 0.42 | 109 | 0.11 |
| Comparative steel 4 | 0.13 | 0.40 | 2.41 | 0.028 | 0.020 | 0 | 0.01 | 0.15 | 0.59 | 154 | 0.15 |
| Comparative steel 5 | 0.09 | 0.15 | 2.46 | 0.050 | 0.030 | 0.0025 | 0.85 | 0.17 | 0.71 | 237 | 0.67 |
| Comparative steel 6 | 0.14 | 0.80 | 1.85 | 0.001 | 0.010 | 0 | 0.05 | 0.01 | 0.51 | 99 | 0.01 |

[Relation 1] $C + Mn/6 + (Cr + Mo + V)/5 + (Si + Ni + Cu)/15$

[Relation 2] $48.8 + 49\log C + 35.1Mn + 25.9Si + 76.5Cr + 105.9Mo + 1325Nb$

[Relation 3] $Mo + 200B$

TABLE 2

| Steel type No. | Classification | Annealing temperature (° C.) | Crack time (sec) | First cooling rate (° C./sec) | First cooling end temperature (° C.) | Second cooling rate (° C./sec) | Second finish end temperature (° C.) |
|---|---|---|---|---|---|---|---|
| Inventive steel 1 | Inventive Example 1 | 840 | 180 | 3 | 650 | 20 | 400 |
| Inventive steel 2 | Inventive Example 2 | 840 | 150 | 3 | 650 | 20 | 400 |
| Inventive steel 3 | Inventive Example 3 | 840 | 130 | 3 | 650 | 20 | 400 |
| Inventive steel 4 | Inventive Example 4 | 840 | 150 | 3 | 650 | 20 | 390 |
| Inventive steel 5 | Inventive Example 5 | 840 | 150 | 3 | 650 | 20 | 380 |
| Inventive steel 6 | Inventive Example 6 | 840 | 150 | 3 | 650 | 20 | 380 |
| Inventive steel 7 | Inventive Example 7 | 840 | 150 | 3 | 650 | 20 | 380 |
| Inventive steel 8 | Inventive Example 8 | 840 | 150 | 3 | 650 | 20 | 400 |
| Inventive steel 9 | Inventive Example 9 | 840 | 150 | 3 | 650 | 20 | 400 |
| Inventive steel 10 | Inventive Example 10 | 840 | 150 | 3 | 650 | 20 | 400 |
| Inventive steel 11 | Inventive Example 11 | 840 | 150 | 3 | 650 | 20 | 400 |
| Inventive steel 12 | Inventive Example 12 | 840 | 150 | 3 | 650 | 20 | 400 |
| Inventive steel 13 | Comparative Example 1 | 770 | 150 | 3 | 650 | 20 | 400 |
| Inventive steel 14 | Comparative Example 2 | 790 | 150 | 3 | 650 | 20 | 400 |
| Inventive steel 15 | Comparative Example 3 | 800 | 150 | 3 | 650 | 20 | 400 |
| Inventive steel 16 | Comparative Example 4 | 810 | 150 | 3 | 650 | 20 | 400 |
| Inventive steel 17 | Comparative Example 5 | 840 | 45 | 3 | 650 | 20 | 400 |
| Inventive steel 18 | Comparative Example 6 | 840 | 150 | 3 | 650 | 20 | 350 |

TABLE 2-continued

| Steel type No. | Classification | Annealing temperature (° C.) | Crack time (sec) | First cooling rate (° C./sec) | First cooling end temperature (° C.) | Second cooling rate (° C./sec) | Second finish end temperature (° C.) |
|---|---|---|---|---|---|---|---|
| Inventive steel 19 | Comparative Example 7 | 840 | 150 | 3 | 650 | 20 | 420 |
| Inventive steel 20 | Comparative Example 8 | 840 | 150 | 3 | 650 | 20 | 410 |
| Inventive steel 21 | Comparative Example 9 | 840 | 150 | 3 | 650 | 20 | 390 |
| Inventive steel 22 | Comparative Example 10 | 840 | 150 | 3 | 650 | 20 | 380 |
| Comparative steel 1 | Comparative Example 11 | 840 | 150 | 3 | 650 | 20 | 400 |
| Comparative steel 2 | Comparative Example 12 | 840 | 150 | 3 | 650 | 20 | 400 |
| Comparative steel 3 | Comparative Example 13 | 840 | 150 | 3 | 650 | 20 | 400 |
| Comparative steel 4 | Comparative Example 14 | 840 | 150 | 3 | 650 | 20 | 400 |
| Comparative steel 5 | Comparative Example 16 | 840 | 150 | 3 | 650 | 20 | 400 |
| Comparative steel 6 | Comparative Example 17 | 840 | 150 | 3 | 650 | 20 | 400 |

TABLE 3

| Steel type No. | Classification | Ms temperature (° C.) | Ms − second cooling end temperature (A) (° C.) | Overaging treatment temperature (° C.) | Overaging treatment temperature − second cooling end temperature (B) (° C.) | Relation 6 | Relation 7 | Relation 8 |
|---|---|---|---|---|---|---|---|---|
| Inventive steel 1 | Inventive Example 1 | 408 | 8 | 400 | 0 | 22 | 25 | 1.1 |
| Inventive steel 2 | Inventive Example 2 | 412 | 12 | 400 | 0 | 34 | 37 | 1.1 |
| Inventive steel 3 | Inventive Example 3 | 408 | 8 | 400 | 0 | 22 | 25 | 1.1 |
| Inventive steel 4 | Inventive Example 4 | 408 | 18 | 390 | 0 | 50 | 56 | 1.1 |
| Inventive steel 5 | Inventive Example 5 | 408 | 28 | 380 | 0 | 78 | 87 | 1.1 |
| Inventive steel 6 | Inventive Example 6 | 407 | 27 | 400 | 20 | 86 | 130 | 1.5 |
| Inventive steel 7 | Inventive Example 7 | 409 | 29 | 410 | 30 | 96 | 159 | 1.7 |
| Inventive steel 8 | Inventive Example 8 | 417 | 17 | 400 | 0 | 48 | 53 | 1.1 |
| Inventive steel 9 | Inventive Example 9 | 417 | 17 | 400 | 0 | 48 | 53 | 1.1 |
| Inventive steel 10 | Inventive Example 10 | 418 | 18 | 400 | 0 | 50 | 56 | 1.1 |
| Inventive steel 11 | Inventive Example 11 | 413 | 13 | 400 | 0 | 36 | 40 | 1.1 |
| Inventive steel 12 | Inventive Example 12 | 416 | 16 | 400 | 0 | 45 | 50 | 1.1 |
| Inventive steel 13 | Comparative Example 1 | 408 | 8 | 400 | 0 | 22 | 25 | 1.1 |
| Inventive steel 14 | Comparative Example 2 | 412 | 12 | 400 | 0 | 34 | 37 | 1.1 |
| Inventive steel 15 | Comparative Example 3 | 404 | 4 | 400 | 0 | 11 | 12 | 1.1 |
| Inventive steel 16 | Comparative Example 4 | 412 | 12 | 400 | 0 | 34 | 37 | 1.1 |
| Inventive steel 17 | Comparative Example 5 | 416 | 16 | 400 | 0 | 45 | 50 | 1.1 |
| Inventive steel 18 | Comparative Example 6 | 412 | 62 | 400 | 50 | 199 | 307 | 1.5 |
| Inventive steel 19 | Comparative Example 7 | 408 | −12 | 420 | 0 | −34 | −37 | 1.1 |
| Inventive steel 20 | Comparative Example 8 | 404 | −6 | 410 | 0 | −17 | −19 | 1.1 |
| Inventive steel 21 | Comparative Example 9 | 413 | 23 | 430 | 40 | 84 | 163 | 1.9 |

TABLE 3-continued

| Steel type No. | Classification | Ms temperature (° C.) | Ms − second cooling end temperature (A) (° C.) | Overaging treatment temperature (° C.) | Overaging treatment temperature − second cooling end temperature (B) (° C.) | Relation 6 | Relation 7 | Relation 8 |
|---|---|---|---|---|---|---|---|---|
| Inventive steel 22 | Comparative Example 10 | 408 | 28 | 440 | 60 | 108 | 225 | 2.1 |
| Comparative steel 1 | Comparative Example 11 | 408 | 8 | 400 | 0 | 22 | 25 | 1.1 |
| Comparative steel 2 | Comparative Example 12 | 412 | 12 | 400 | 0 | 34 | 37 | 1.1 |
| Comparative steel 3 | Comparative Example 13 | 437 | 37 | 400 | 0 | 104 | 115 | 1.1 |
| Comparative steel 4 | Comparative Example 14 | 408 | 8 | 400 | 0 | 22 | 25 | 1.1 |
| Comparative steel 5 | Comparative Example 16 | 425 | 25 | 400 | 0 | 70 | 78 | 1.1 |
| Comparative steel 6 | Comparative Example 17 | 418 | 18 | 400 | 0 | 50 | 56 | 1.1 |

[Relation 6] 2.8A + 0.5B
[Relation 7] 3.1A + 2.3B
[Relation 8] (3.1A + 2.3B)/(2.8A + 0.5B)

TABLE 4

| Classification | Tempered martensite fraction (% by area) | Tempered martensite average length of lath short axis (nm) | Yield strength (YS) (MPa) | Tensile strength (TS) (MPa) | Yield ratio | Elongation rate (EL) (%) | Hole expansion ratio (HER) (%) | Bendability (YS × EL × HER) (GPa %%) | Whether cracks occur in 180° complete compression bending test |
|---|---|---|---|---|---|---|---|---|---|
| Inventive Example 1 | 90 | 185 | 859 | 1021 | 0.84 | 10.4 | 58 | 518 | ○ |
| Inventive Example 2 | 91 | 175 | 855 | 1015 | 0.84 | 11.1 | 53 | 503 | ○ |
| Inventive Example 3 | 92 | 195 | 842 | 1017 | 0.83 | 10.8 | 61 | 555 | ○ |
| Inventive Example 4 | 93 | 200 | 887 | 1040 | 0.85 | 10.6 | 67 | 630 | ○ |
| Inventive Example 5 | 93 | 225 | 899 | 1060 | 0.85 | 10.2 | 65 | 596 | ○ |
| Inventive Example 6 | 91 | 175 | 838 | 996 | 0.84 | 9.7 | 58 | 471 | ○ |
| Inventive Example 7 | 90 | 184 | 847 | 986 | 0.86 | 10.1 | 54 | 462 | ○ |
| Inventive Example 8 | 89 | 205 | 835 | 1065 | 0.78 | 10.5 | 57 | 500 | ○ |
| Inventive Example 9 | 87 | 235 | 846 | 998 | 0.85 | 11.5 | 55 | 628 | ○ |
| Inventive Example 10 | 90 | 221 | 889 | 1096 | 0.81 | 10.9 | 67 | 649 | ○ |
| Inventive Example 11 | 89 | 215 | 856 | 1101 | 0.78 | 9.4 | 59 | 475 | ○ |
| Inventive Example 12 | 90 | 175 | 834 | 1050 | 0.79 | 10.7 | 57 | 509 | ○ |
| Comparative Example 1 | 59 | 120 | 615 | 1098 | 0.56 | 8.7 | 34 | 182 | x |
| Comparative Example 2 | 61 | 142 | 596 | 1038 | 0.57 | 11.4 | 33 | 224 | x |
| Comparative Example 3 | 62 | 152 | 619 | 1031 | 0.60 | 12.9 | 36 | 287 | x |
| Comparative Example 4 | 74 | 165 | 701 | 1011 | 0.69 | 13.4 | 38 | 357 | x |
| Comparative Example 5 | 62 | 174 | 620 | 952 | 0.65 | 14.9 | 34 | 314 | x |
| Comparative Example 6 | 99 | 185 | 955 | 1082 | 0.88 | 7.6 | 56 | 406 | x |
| Comparative Example 7 | 78 | 148 | 766 | 972 | 0.79 | 12.1 | 37 | 343 | x |
| Comparative Example 8 | 74 | 165 | 776 | 983 | 0.79 | 12.0 | 42 | 391 | x |
| Comparative Example 9 | 79 | 187 | 861 | 971 | 0.89 | 11.2 | 52 | 501 | x |
| Comparative Example 10 | 76 | 179 | 874 | 945 | 0.92 | 11.6 | 57 | 578 | x |

TABLE 4-continued

| Classification | Tempered martensite fraction (% by area) | Tempered martensite average length of lath short axis (nm) | Yield strength (YS) (MPa) | Tensile strength (TS) (MPa) | Yield ratio | Elongation rate (EL) (%) | Hole expansion ratio (HER) (%) | Bendability (YS × EL × HER) (GPa %%) | Whether cracks occur in 180° complete compression bending test |
|---|---|---|---|---|---|---|---|---|---|
| Comparative Example 11 | 55 | 174 | 568 | 767 | 0.74 | 27.9 | 33 | 523 | x |
| Comparative Example 12 | 54 | 165 | 567 | 846 | 0.67 | 17.4 | 32 | 316 | x |
| Comparative Example 13 | 70 | 177 | 693 | 950 | 0.73 | 11.3 | 35 | 274 | x |
| Comparative Example 14 | 72 | 185 | 707 | 854 | 0.83 | 19.5 | 37 | 510 | x |
| Comparative Example 16 | 99 | 256 | 925 | 1107 | 0.80 | 7.1 | 56 | 421 | x |
| Comparative Example 17 | 53 | 154 | 558 | 725 | 0.77 | 27.8 | 32 | 496 | x |

As shown in Tables 1 to 4, it was found that Inventive Examples 1 to 12 which satisfied the alloy compositions and the manufacturing conditions suggested by the present disclosure had excellent mechanical properties by securing the microstructure to be obtained in the present disclosure.

However, it was confirmed that Comparative Examples 1 to 17 which did not satisfy the alloy compositions or the manufacturing conditions suggested by the present disclosure had poor mechanical properties by not securing the microstructure to be obtained in the present disclosure.

Figure 2:
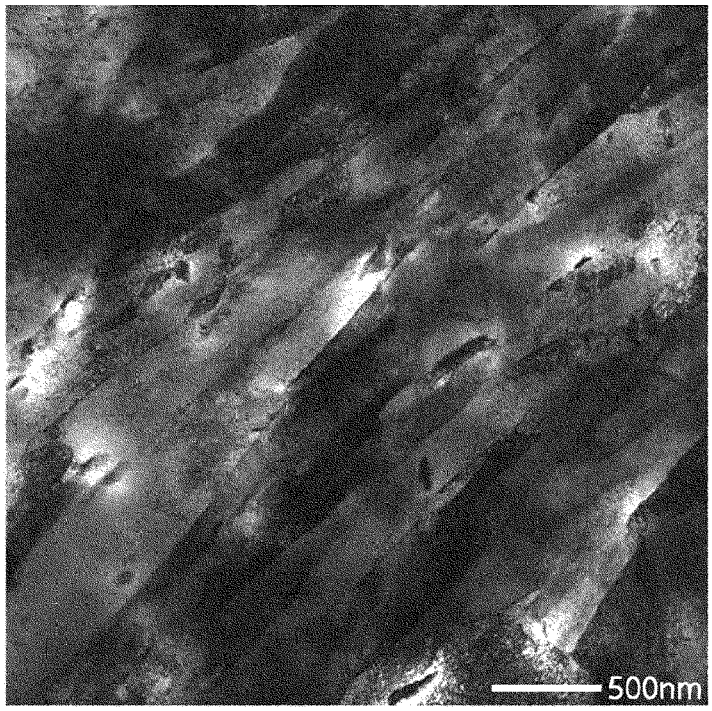
FIG. 2 is an image of a microstructure of Inventive Example 1 according to an exemplary embodiment in the present disclosure, which was observed by TEM.

FIG. 1 is an image of the microstructure of Inventive Example 1 observed by SEM, and FIG. 2 is an image of the microstructure of Inventive Example 1 observed by TEM. As seen from FIGS. 1 and 2, it was confirmed that in Inventive Example 1, tempered martensite which was the main structure of the present disclosure was uniformly distributed.

The invention claimed is:

1. A cold rolled steel sheet comprising, by weight: 0.06 to 0.17% of C, 0.1 to 0.8% of Si, 1.9 to 2.9% of Mn, 0.005 to 0.07% of Nb, 0.004 to 0.05% of Ti, 0.0004 to 0.005% of B, 0.20% or less (excluding 0%) of Cr, and 0.04 to 0.45% of Mo, with a balance of Fe and unavoidable impurities, and satisfying the following Relations 1 to 3; and a microstructure including, by area, 80 to 98% of tempered martensite and a balance of fresh martensite, bainite, ferrite, and residual austenite, wherein an average length of lath short axis of the tempered martensite is 500 nm or less, $$0.40 \le C + Mn/6 + (Cr + Mo + V)/5 + (Si + Ni + Cu)/15 \le 0.70, \quad \text{[Relation 1]}$$

$$110 \le 48.8 + 49\log C + 35.1\,Mn + 25.9Si + 76.5Cr + 105.9Mo + 1325Nb \le 210, \quad \text{[Relation 2]}$$

and $$0.20 \le Mo + 200B \le 00.70, \quad \text{[Relation 3]}$$

wherein contents of alloy components described are based on % by weight.

2. The cold rolled steel sheet of claim 1, wherein the impurities include one or more of P, S, Al, Sb, N, Mg, Sn, Sb, Zn, and Pb as a tramp element, of which a sum is 0.1% by weight or less.

3. The cold rolled steel sheet of claim 1, wherein the fresh martensite is 11% or less, bainite is 3% or less, ferrite is 3% or less, and residual austenite is 3% or less.

4. The cold rolled steel sheet of claim 1, further comprising: a yield strength (YS) of 780 to 920 MPa, a tensile strength (TS) of 980 to 1200 MPa, an elongation rate (EL) of 8% or more, a yield ratio (YS/TS) of 0.75 or more, a hole expansion ratio (HER) of 40% or more, and a bendability (YS×EL×HER) of 300 GPa % % or more, and no crack occurrence in a 180° complete compression bending test.

5. A method of manufacturing a cold rolled steel sheet, the method comprising:

heating a slab including, by weight: 0.06 to 0.17% of C, 0.1 to 0.8% of Si, 1.9 to 2.9% of Mn, 0.005 to 0.07% of Nb, 0.004 to 0.05% of Ti, 0.0004 to 0.005% of B, 0.20% or less (excluding 0%) of Cr, and 0.04 to 0.45% of Mo with a balance of Fe and unavoidable impurities, and satisfying the following Relations 1 to 3;

finish rolling the heated slab so that a finish rolling outlet side temperature is Ar3+50° C. to Ar3+150° C., thereby obtaining a hot rolled steel sheet;

cooling the hot rolled steel sheet to Ms+50° C. to Ms+300° C. and then winding the cooled hot rolled steel sheet;

cold rolling the wound hot rolled steel sheet to obtain a cold rolled steel sheet;

continuously annealing the cold rolled steel sheet in a temperature range of 820 to 860° C.;

crack treating the continuously annealed cold rolled steel sheet for 50 to 200 seconds;

first cooling the crack treated cold rolled steel sheet down to 620 to 700° C. at a cooling rate of 1 to 10° C./s;

second cooling the first cooled cold rolled steel sheet down to 360 to 420° C. at a cooling rate of 5 to 50° C./s; and subjecting the second cooled cold rolled steel sheet to an overaging treatment at 370 to 420° C. or the overaging treatment after reheating, wherein in the second cooling and the overaging treatment, the following Relations 4 to 8 are satisfied:

$$0.40 \le C + Mn/6 + (Cr + Mo + V)/5 + (Si + Ni + Cu)/15 \le 0.70, \quad \text{[Relation 1]}$$

$$110 \le 48.8 + 49\log C + 35.1\ 25.9Si + 76.5Cr + 105.9Mo + 1325Nb \le 210, \quad \text{[Reaction 2]}$$

-continued $$0.20 \leq \mathrm{Mo} + 200\mathrm{B} \leq 00.70, \quad \text{[Relation 3]}$$

$$0 \leq A \leq 50, \quad \text{[Relation 4]}$$

$$0 \leq B \leq 40, \quad \text{[Relation 5]}$$

$$0 \leq 2.8A + 0.5B \leq 100, \quad \text{[Relation 6]}$$

$$0 \leq 3.1A + 2.3B \leq 200, \text{ and} \quad \text{[Relation 7]}$$

$$0.25 \leq (3.1A + 2.3B)/(2.8A + 0.5B) \leq 3.5, \quad \text{[Relation 8]}$$

wherein contents of alloy components described in Relations 1 to 3 are based on % by weight, and A is Ms—a second cooling end temperature (C) and B is an overaging treatment temperature—a second cooling end temperature (° C.), in Relations 4 to 8.

6. The method of claim 5, wherein the heating of a slab is performed at 1100 to 1300° C.

7. The method of claim 5, wherein the slab has a thickness of 230 to 270 mm.

8. The method of claim 5, further comprising: after the winding, cooling the wound hot rolled steel sheet to room temperature at a cooling rate of 0.1° C./s or less.

9. The method of claim 5, wherein the cold rolling is performed at a reduction rate of 40 to 70%.

10. The method of claim 5, further comprising: after the overaging treatment, roughly rolling the overaging treated cold rolled steel sheet at an elongation rate of 0.1 to 2.0%.

* * * * *